US005381610A

United States Patent [19]

Hanson

[11] Patent Number: 5,381,610

[45] Date of Patent: Jan. 17, 1995

[54] CONVERTIBLE FOOTWEAR

[76] Inventor: Violet M. Hanson, 14 Fairway Dr., Old Bethpage, N.Y. 11804

[21] Appl. No.: 250,642

[22] Filed: May 27, 1994

Related U.S. Application Data

[63] Continuation of Ser. No. 45,894, Apr. 12, 1993, abandoned, which is a continuation-in-part of Ser. No. 739,680, Aug. 2, 1991, abandoned, which is a continuation-in-part of Ser. No. 589,638, Sep. 28, 1990, abandoned, and a continuation-in-part of Ser. No. 664,770, Mar. 5, 1991, abandoned.

[51] Int. Cl.[6] ..... A43B 3/24; A43B 1/10; A43B 1/02

[52] U.S. Cl. ..... 36/100; 36/102; 36/9 R; 36/11; 36/16; 12/142 T

[58] Field of Search ..... 36/100, 102, 9 R, 9 A, 36/11, 7.1 R, 16; 12/142 G, 142 MC, 142 T; 2/164

[56] References Cited

U.S. PATENT DOCUMENTS

| | | | |
|---|---|---|---|
| 992,221 | 5/1911 | Loewenbach | 36/9 R |
| 1,916,067 | 6/1933 | Naidor | 36/9 R |
| 2,304,236 | 12/1942 | Braun | 36/16 |
| 2,409,813 | 10/1946 | Timson | 36/9 R |
| 2,521,461 | 9/1950 | Lathan | 36/16 |
| 2,563,092 | 8/1951 | Zacks | 36/16 |
| 2,806,301 | 9/1957 | Meltzer | 36/9 R |
| 3,120,711 | 2/1964 | Scholl | 36/9 R |
| 4,246,707 | 1/1981 | Pedersen | 36/100 |
| 4,679,257 | 7/1987 | Town | 2/164 |
| 4,847,918 | 7/1989 | Sturm | 2/164 |
| 4,918,756 | 4/1990 | Grilliot et al. | 2/164 |

*Primary Examiner*—Paul T. Sewell
*Assistant Examiner*—Marie Denise Patterson
*Attorney, Agent, or Firm*—Bauer & Schaffer

[57] ABSTRACT

Footwear having a pair of slipper or footwear/shoe members joined together. Each member is formed of a flexible upper body and a sole secured thereto about the perimeter. The two slipper or footwear/shoe members are further joined with their soles abutting each other.

7 Claims, 4 Drawing Sheets

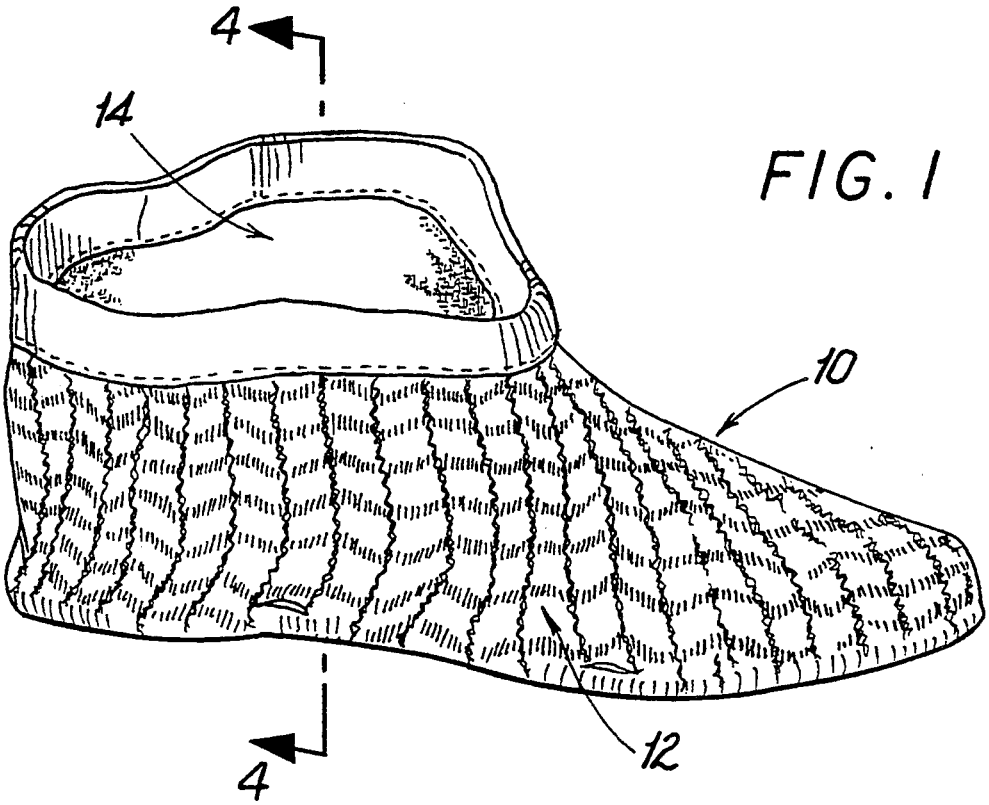
FIG. 1
FIG. 2
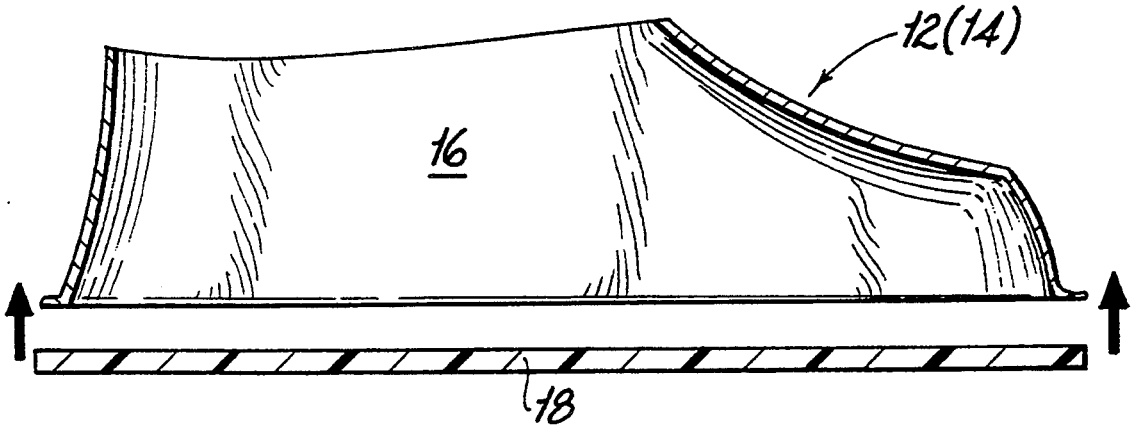

CONVERTIBLE FOOTWEAR

RELATED APPLICATIONS

This is a continuation of Ser. No. 08/045,894, filed Apr. 12, 1993, which is a continuation-in-part of Applicant's earlier copending application, Ser. No. 739,680, filed Aug. 2, 1991, which is a continuation-in-part of Ser. No. 589,638, filed Sep. 28, 1990, and copending application Ser. No. 664,770, filed Mar. 5, 1991, all now abandoned, for which priority under 35 U.S.C. 120 is claimed.

Portions of the subject matter disclosed herein are contained in Disclosure Document No. 286,881, filed Jul. 17, 1991 and Disclosure Document No. 308,097, filed Apr. 28, 1992.

FIELD OF THE INVENTION

The present invention relates to the method of constructing reversible footwear.

BACKGROUND OF THE INVENTION

Lightweight, light-duty footwear such as slippers which are convertible between indoor and outdoor use have described in my copending application Ser. Nos. 589,638 and 664,770. As described in these applications, the advantages and benefits of such slippers or footwear are numerous, and they allow the user comfort both indoors and outdoors without the need to have more than one pair of footwear.

It is an object of the present invention to provide slippers and footwear which not only can be so convertible but which have an improved construction from which a highly pleasing and attractive design can be created, which is simple and inexpensive to make.

Other objects and advantages of the instant invention will become obvious to persons of skill in the art upon contemplation of the disclosure herein.

SUMMARY OF THE INVENTION

According to the present invention, one type of changeable footwear having different internal and external appearances which are convertible by turning the body inside out is provided. The footwear is constructed by first separately constructing a complete inner slipper or footwear member (normally the indoor side or the side which, in a conventional slipper or footwear, would be called the lining) and a complete outer member (normally considered the exterior side of the slipper or footwear). Each of the inner and outer members comprises substantially complete footwear having a decorative body portion and a sole having an exterior tread surface. When the perimeters of the inside out abutting soles are sewn or adhered by other means, together they form a single sole member having two surfaces, each capable of being the outer tread or the inner sole. In order to select which member is to be external for which purpose, the user freely changes the footwear by reversal of the inner and outer members.

In another aspect of the invention, a pair of sole elements is joined back to back, and a wide strap is fixed at its ends between the sole elements to extend over the wearer's instep. By reversing the strap, one or the other of the soles is exposed.

Full details of the present invention are set forth in the following description of the invention and illustrated in the accompanying drawings.

BRIEF DESCRIPTION OF THE DRAWINGS

In the drawings:

FIG. 1 is a perspective view of a slipper or footwear embodying the present invention;

FIG. 2 is a longitudinal sectional view of a slipper or footwear body and sole before affixation to each other;

DESCRIPTION OF THE INVENTION

Figure 3:
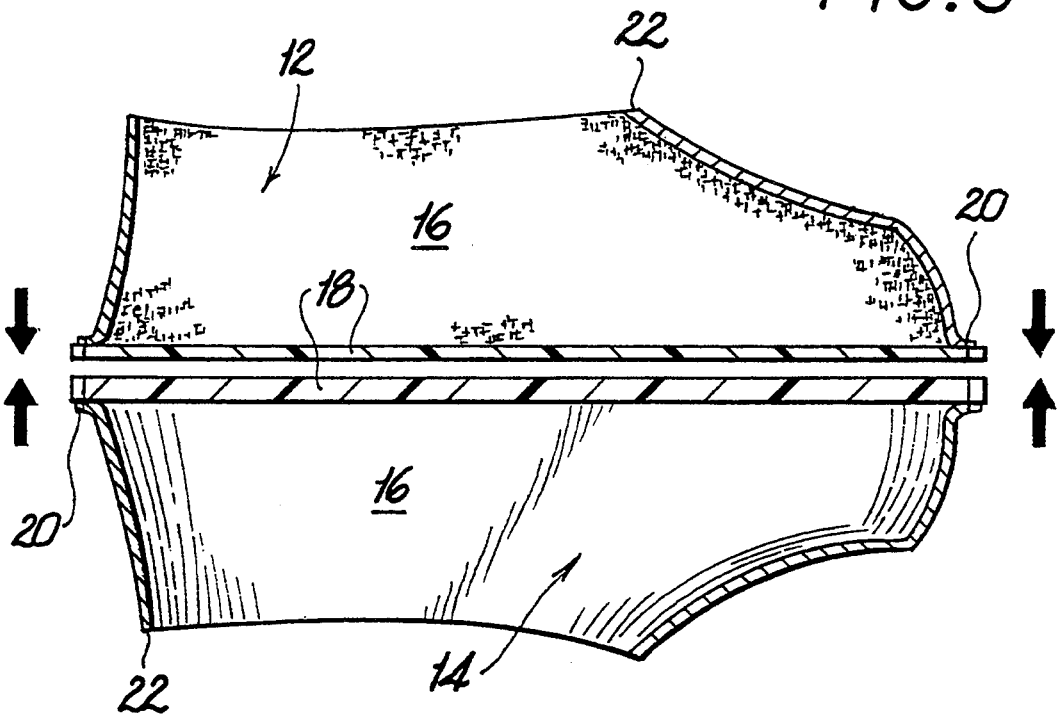
FIG. 3 is an enlarged view of an inner and outer members, each being turned inside out in preparedness for abutting attachment.

A convertible slipper embodying the present invention is illustrated in FIGS. 1–4 and is generally depicted by the numeral 10. The slipper is formed by two similar and congruent complete members 12 and 14 as seen in FIG. 3. The first member 12 may be nominally considered to be the exterior or outer wear side, while the second member 14 may be nominally considered to be the interior or inner wear side, although their positions according to the present invention are easily reversed.

As seen in FIG. 2, each member 12 and 14 comprises an upper body 16, which may be of one piece, as when the same is in the form of a knit fabric, or of several pieces when woven or plastic fabric is used, and a sole member 18, which is preferably made of soft leather, plastic or similar soft sole material. A wide variety of material for each of the bodies and soles may be used, and the selection, of course, will depend as much upon the desired style and decoration as it will the ultimate uses. Preferably, the upper body 16 and sole 18 of each member will be decoratively different. Manufacture of the body and sole will otherwise follow conventional processes, except as may be hereinafter modified.

As seen further in FIG. 3, the exterior and interior slipper or footwear members 12 and 14 are assembled by attaching each body 16 separately to its associated sole 18 and then thereafter securing the body and sole together about their common peripheral edges. The assembled body and sole are turned inside out so that the so-called decorative surfaces are exposed. The body and sole portions are preferably sewn or adhered together by other means, leaving a small peripheral flange or welt 20 with its raw edge exposed. A California over-stitch, running hem stitch, or the like may be used. If desired, the two pieces, i.e. body and sole, may be glued, heat sealed, or otherwise secured together in known manner, considering the materials used and the ultimate design of the slipper or footwear.

Once each of the two slipper or footwear members 12 and 14 are assembled in the reversed condition shown in FIG. 3, they are arranged as seen so that their soles are in overlying abutting relationship. The members 12 and 14 are then sewn or adhered together through the flange welts 20 completely about the common periphery, effectively providing a common foot having a tread outsole and an insole. Following the sewing or adhesion by other means of the two members 12 and 14 together, one member, most generally the outer member 12, is reinverted and reversed so that it is brought upwardly to overlie and cover the other member. Since the two members 12 and 14 are congruent, the upper edges 22 of each of the members are substantially aligned. The upper edges 22 are then sewn or adhered together by other means, thereby forming a completely uniform slipper or footwear in which the inner member 14 serves as a lining or the like for the outer member 12. The sewing of the two soles can be made through the inside of the body so that stitching is not obvious once the slipper is completed. Thereafter, one of the body members is inverted to the upper edges of each body joined. In this construction, the rolled edge of the welt is visible only on one side of the slipper when it is the exterior side, while on the other side, only the binding is visible when it is the exterior side.

Figure 4:
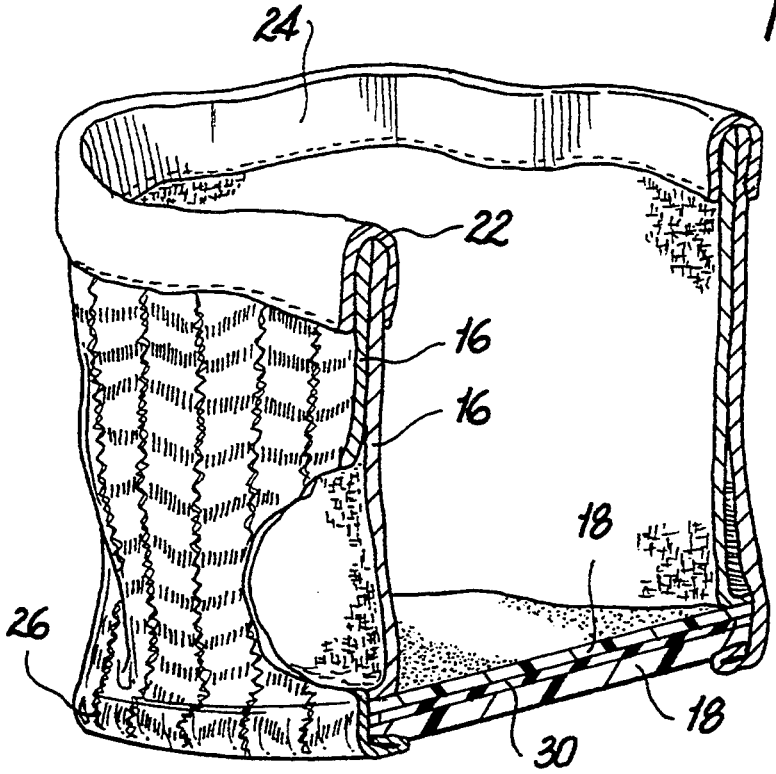
FIG. 4 is a sectional view of the slipper or footwear taken along line 4—4 of FIG. 1.

As seen in FIG. 4, the upper edges 22 may be covered with a strip of binding 24 which may be elastic to make an ankle closure in the manner of an established booty or similar shoe. The slipper or footwear may be repeatedly reversed to expose either the outer member 12 or the inner member 14.

A significant result of this construction as seen in FIG. 4 is the formation of a rolled edge 26 about the entire periphery of the sole portion of the slipper. No matter which side of the slipper is exposed when assembled, the flange welt 20 is rolled and tucked into the slipper or footwear. Such a rolled edge 26 provides not only the appearance of a soft slipper but also the comfort of a soft slipper or footwear in that the seams, joining the upper bodies to the soles and the two soles together, are effectively drawn interiorly into the peripheral edge. Thus, the seams will not interfere with the normal walk or tread of the wearer.

While it is preferred that both soles be flexible and relatively soft, it is clear that the sole which is normally exposed may be made of stronger, more rigid and more weatherproof material than that of the interior member. Similar variations in the material or structure of the bodies 16 may be made. Of course, both upper bodies 16 are desirably made decorative either by use of decorative materials or by application of desired decorations thereon.

The layer forming the normally outer member 12 is made of flexible material generally used in slipper or footwear or lightweight shoe manufacture such as fabric, thin leather, or thin plastic in a single layer or double-sided laminate form. The layer forming the normally inner member 14 is made of similar or even the same material of a lighter gauge or weight. The surfaces of the upper bodies 16 of each member 12, 14 preferably have different appearances (i.e. color, design, material, etc.). Since the upper bodies 16 are constructed to be highly flexible, each can be turned inside out, causing the internal and external surfaces of the upper bodies 16 as well as of the soles 18 to be exchanged, thus selectively changing the appearance displayed when the slipper or footwear 10 is worn. The purpose to which the footwear is put depends solely upon the whim and selection of the owner.

Figure 5:
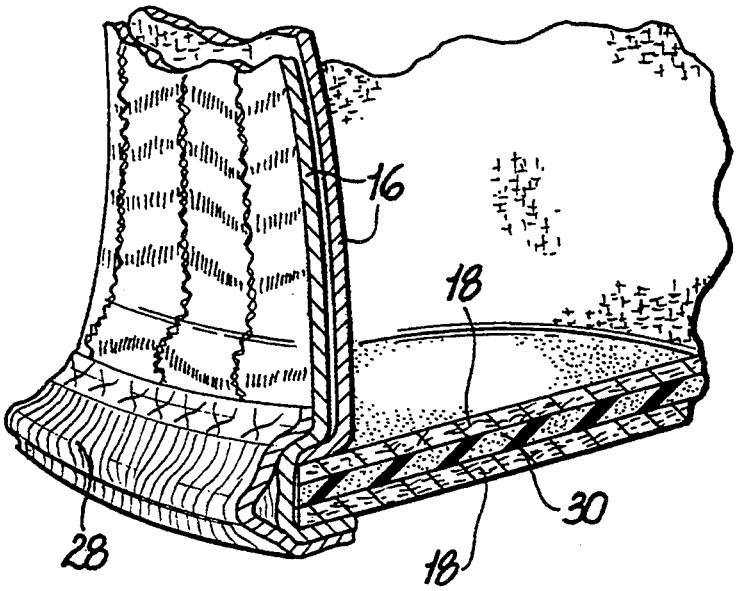
FIG. 5 is a breakaway view of a finished slipper of FIG. 1, illustrating interior constructional embodiments.

Alternatively, once the two sole members are abutted surface. to surface, a narrow strip of binding 28 can be stitched about the periphery, the stitching preferably passing through the binding of each sole so as to integrally join them intergrally. As seen in FIG. 5, the binding 28 may be made of bias, grosgrain, bengaline, or leather material and is oversewn on the peripheral welt 20 on one side of the slipper (exterior or interior) to provide a seemingly different ornamental appearance to the slipper on that side. The binding 28 further acts to strengthen the slipper and prevent fraying of the material in use.

Figure 6:
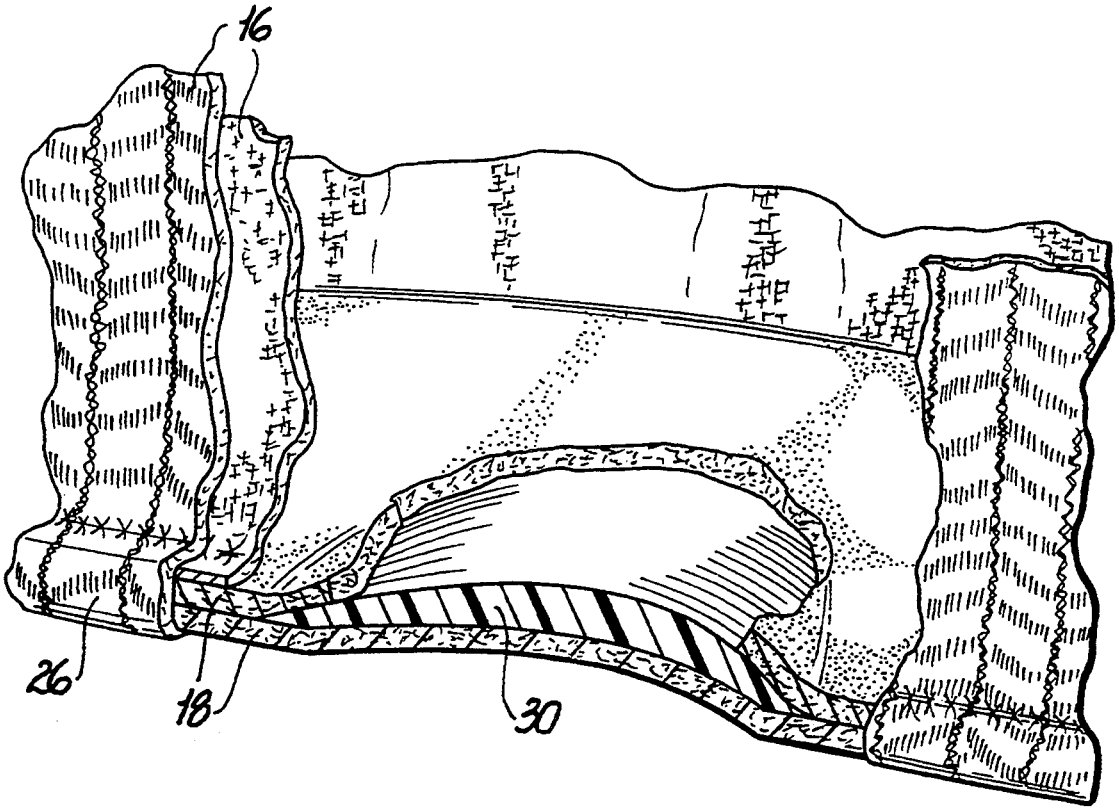
FIG. 6 is a breakaway view similar to that of FIG. 5, illustrating other interior constructions.
Figure 7:
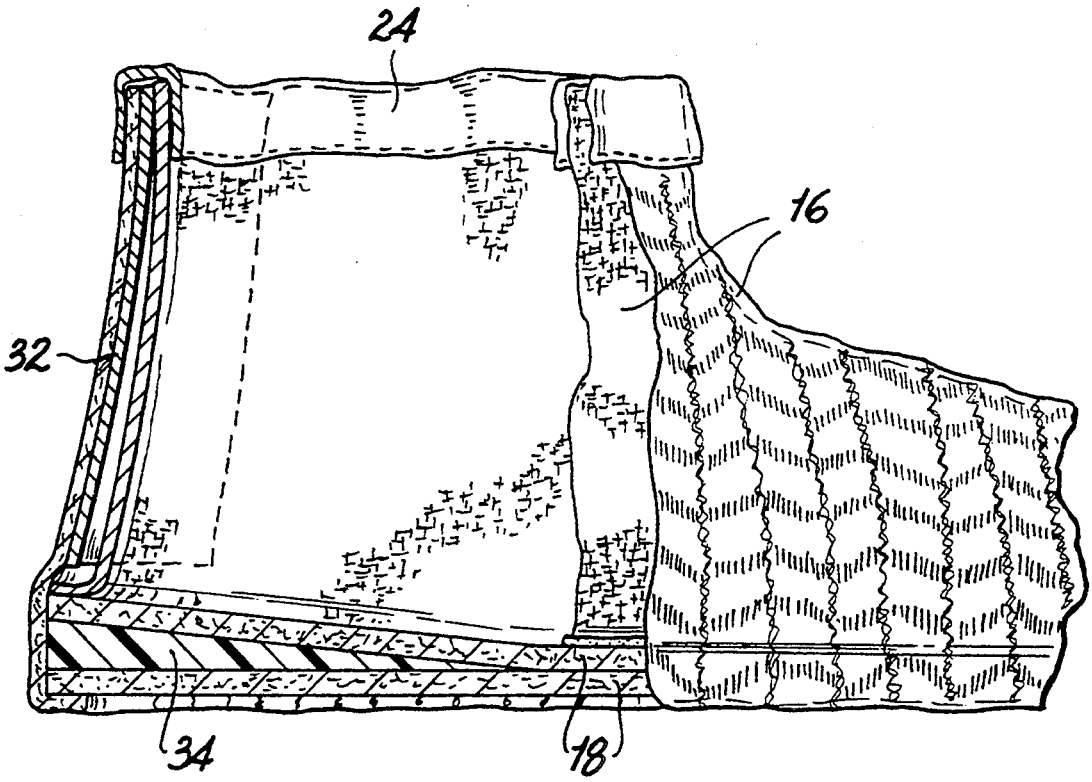
FIG. 7 is an elevational view of the slipper of FIG. 1, partially cut away to illustrate further constructional features.

The slipper soles 18 may be reinforced and built up with an intermediate layer 30 of foam or rubbery material to provide a degree of stiffness and shape retention as well as increased arch support. The intermediate layer 30 may extend the whole length of the slipper or may be confined to the heel or metatarsal sections as desired. Preferably, the intermediate layer 30 is inserted without attachment to either sole 18, thereby permitting the slipper to be reversed without bunching of the intermediate layer. The intermediate sole member 30 can be flat as seen in FIG. 4; foamed as seen in FIG. 5; and/or arched or shaped as seen in FIG. 6. Similarly, a rigid arch support can be inserted between the sole along the longitudinal sides of the slipper, alone or in combination with a softer intermediate layer 30. A separate in-sole or sock liner may also be used to cover the outer tread surface next to the foot when the footwear is reversed from outdoor to indoor.

The back of the heel may also be reinforced with a back counter 32. The back counter 32, preferably formed of leather or plastic and having a rigidity or body substantially greater than that of the material used to form the upper body 12 of the slipper, is inserted between the layers of each of the upper bodies so as to be effective in strengthening the heel but is also unseen. On the other hand, a back counter 32 can be placed on the exterior surface of either or both of the layers forming the upper body 12 so as to be a part of the decorative design of the slipper. The back counter may be stitched, heat soldered, or glued to one or both layers of the upper body 12 as is convenient.

It may also be desirable to provide a heel wedge 34 between the soles 18 to provide a more natural and customary lift to the slipper at the heel. Such a wedge tapers slightly from the rearmost edge inwardly toward the central arch of the slipper and, if desired, may be shaped saddle-like on its surfaces for comfortable seating of the wearer's foot. A solid resinous material may be used for the heel wedge.

Figure 8:
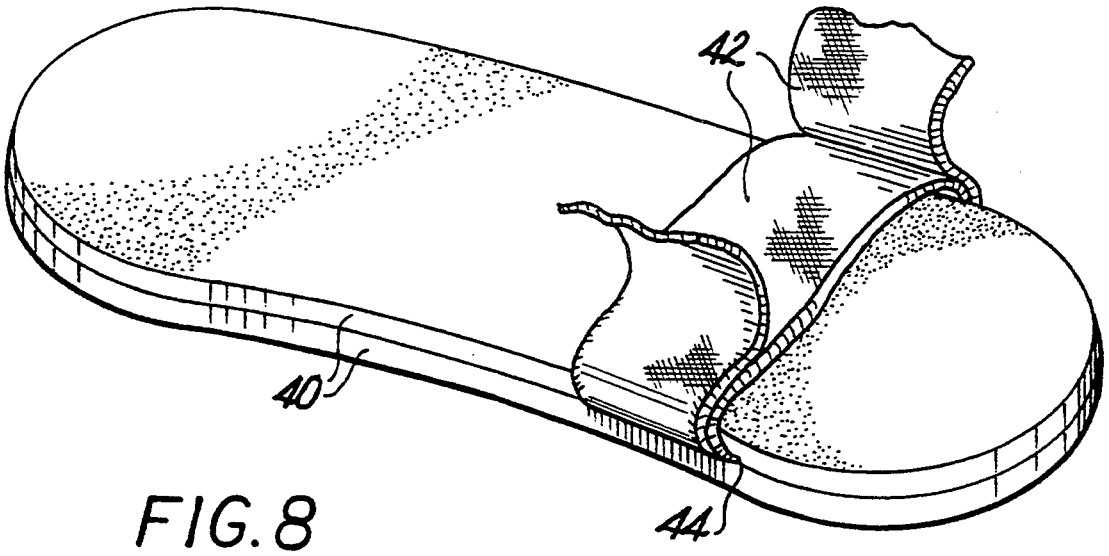
FIG. 8 is a perspective view of another embodiment of the present invention.

Another aspect of the present invention is seen in FIG. 8. Here, a simple slipper may be formed by joining a sole 40 and a strap 42 together in a fashion similar to that earlier described. To further simplify construction, the straps of the two slipper member may be sewn or adhered together before attachment to the soles. The soles are provided with slight undercuts or recess 44 to receive the straps. The straps 42 are preferably formed of elastic or knit material so as to stretch across the instep section. Preferably, the two layers of the sole 40 are stitched together about the common peripheral edge to form a welt, and the strap 42 is sewn therebetween as in the earlier described embodiments so as to form with them an integral unitary construction. Each strap member 42 itself or the joint strap may be a single unitary band which passes tranversely from side to side across the slipper and over the top. This latter construction insures integrity of straps and slipper soles even through extensive wear.

In use, each strap may have a different decorative and/or textured characteristic to provide a different appearance from each side. The appearance of the slipper is changed by reversing the elastic strap 42. Thus, reversal of the soles from inner to outer and vice versa changes the outward appearance of the strap.

The slipper seen in FIG. 8 may be provided with a cushioning intermediate sole layer and/or heel wedge as shown in the earlier embodiment.

It is clear from the foregoing that the present invention is directed to the construction of footwear, preferably lightweight slipper-type shoes formed having two identically constructed bodies—namely, two soles and two upper members which overlie each other and which are sewn together so as to be easily reversible. Effectively, the present invention provides a two body and sole slipper which, if separated, still remains an integral shoe structure.

The above description contains many specificities, which should not be construed as limitations on the scope of the invention but rather as an exemplification of the preferred embodiment thereof. Accordingly, the scope of the instant invention should not be determined by the embodiment described but by the claims appended hereto and their legal equivalents.

What is claimed is:

1. A convertible footwear comprising two structurally congruent members, each having a foot covering portion with an upper edge and a lower edge, and a sole with inner and outer surfaces, the lower edge of the covering portion being attached to the inner surface of its sole about its peripheral edge;

first means for securing said two congruent members together at the peripheral edges of the soles with the outer surfaces of the soles in facing relationship and with the foot covering portion of one of said two congruent members extending over said secured peripheral edge to enclose said peripheral edge between the two foot covering portions of said congruent members; and second means for securing said two foot covering portions together at their upper edges so that the peripheral edge of the two soles and one of the outer sole surfaces is contained within the confines of its respective foot covering portion while the other outer sole surface is exposed for contact with a walking surface depending upon which respective foot covering portion is inverted and turned into covering relationship abutting with the other foot covering portion.

2. The footwear according to claim 1, wherein the outer sole surface of each member is of a different characteristic.

3. The footwear according to claim 1, wherein said foot covering portions are made of flexible material.

4. The footwear according to claim 1, wherein a binding strip is secured to one of said members about the periphery of the two soles.

5. The footwear according to claim 1, including an inner cushion sole located between said soles.

6. The footwear according to claim 1, including a heel wedge between said soles.

7. The footwear according to claim 3 including a heel counter between the inner and outer of the foot covering portions.

* * * * *